US008693855B2

(12) United States Patent
Potter et al.

(10) Patent No.: US 8,693,855 B2
(45) Date of Patent: Apr. 8, 2014

(54) INFRA-RED HEATER ASSEMBLY

(75) Inventors: Gary Joseph Potter, Marthasville, MO (US); Jeffrey Alan Kieffer, St. Louis, MO (US)

(73) Assignee: Cambridge Engineering, Inc, Chesterfield, MO (US)

( * ) Notice: Subject to any disclaimer, the term of this patent is extended or adjusted under 35 U.S.C. 154(b) by 1002 days.

(21) Appl. No.: 12/800,028

(22) Filed: May 6, 2010

(65) Prior Publication Data

US 2010/0329649 A1 Dec. 30, 2010

Related U.S. Application Data

(60) Provisional application No. 61/215,622, filed on May 7, 2009.

(51) Int. Cl.
*F26B 19/00* (2006.01)
*F24D 19/02* (2006.01)

(52) U.S. Cl.
USPC ..... 392/416; 392/363; 392/370; 392/438

(58) Field of Classification Search
None
See application file for complete search history.

(56) References Cited

U.S. PATENT DOCUMENTS 2,613,308 A * 10/1952 La Mirand ..... 219/473
2,961,523 A * 11/1960 Hanson et al. ..... 392/407
3,223,826 A * 12/1965 Macaluso, Jr. ..... 392/413
3,509,334 A * 4/1970 Michailov ..... 362/249.07
3,624,351 A * 11/1971 Kipp ..... 392/376
3,767,895 A * 10/1973 Needham ..... 392/438
3,846,072 A 11/1974 Patterson
3,961,157 A * 6/1976 Miller et al. ..... 392/435
4,017,967 A 4/1977 Wells et al.
4,053,732 A * 10/1977 Carter ..... 392/358
4,164,869 A * 8/1979 Benzinger ..... 236/94
4,200,085 A * 4/1980 Buehl ..... 126/9 B
4,228,345 A 10/1980 Stricker et al.
4,265,029 A * 5/1981 Jenkins ..... 34/266
4,888,469 A * 12/1989 Hennuy et al. ..... 392/360
4,914,273 A * 4/1990 Matsui ..... 219/222
5,050,232 A * 9/1991 Bergman et al. ..... 392/412
5,184,419 A 2/1993 Tallon
5,335,308 A * 8/1994 Sorensen ..... 392/412
5,590,238 A * 12/1996 Ericson ..... 392/412
5,607,711 A 3/1997 Lagunas-Solar
5,838,878 A * 11/1998 Jane et al. ..... 392/376
5,910,267 A * 6/1999 Stricker ..... 219/548
5,968,401 A 10/1999 Roy
6,050,025 A 4/2000 Wilbanks
6,091,888 A * 7/2000 Jane et al. ..... 392/365
6,327,812 B1 12/2001 Hedman et al.

(Continued)

*Primary Examiner* — Thor Campbell
(74) *Attorney, Agent, or Firm* — Paul M. Denk

(57) ABSTRACT

An infra-red heater assembly takes on the conditions that afflict buildings: bed bugs, termites, other insects, molds, bacteria, and the like, and their resulting odors, and other contaminants. The assembly includes a portable electric infra-red emitting panel system with vertically stacked panels that distribute heat energy to the entire height of a wall. Removable panel covers over the infra-red heating elements protect them from damage during transport and when opened, act as deflectors, to direct, the radiant energy, widthwise, to restrict the line of site energy transferred to a wall. The heating panels are regulated by room air and wall temperature sensors to prevent structural damage and fire during usage of the invention. The infra-red heater may be pivotally mounted within its supporting structure so as to direct heat in various angular directions within the building being treated.

13 Claims, 10 Drawing Sheets

(56) References Cited

U.S. PATENT DOCUMENTS

| | | | | |
|---|---|---|---|---|
| 6,731,866 | B2 * | 5/2004 | Ueno | 392/415 |
| 6,842,581 | B2 * | 1/2005 | Schafer | 392/380 |
| 6,892,491 | B2 | 5/2005 | Hedman | |
| 7,407,624 | B2 | 8/2008 | Cumberland et al. | |
| 7,926,222 | B2 * | 4/2011 | Molnar et al. | 43/132.1 |
| 7,974,526 | B2 * | 7/2011 | Chu | 392/419 |
| 8,068,726 | B2 * | 11/2011 | Saunders et al. | 392/407 |
| 8,479,440 | B2 * | 7/2013 | Demonte et al. | 43/132.1 |
| 2002/0048452 | A1 * | 4/2002 | Shimizu | 392/413 |
| 2003/0026727 | A1 * | 2/2003 | Topp | 422/1 |
| 2003/0230477 | A1 | 12/2003 | Fink et al. | |
| 2004/0028583 | A1 | 2/2004 | Hedman | |
| 2005/0105898 | A1 * | 5/2005 | Bachinski et al. | 392/411 |
| 2005/0246942 | A1 * | 11/2005 | Mueller et al. | 43/124 |
| 2006/0018640 | A1 * | 1/2006 | Hinesley | 392/420 |
| 2006/0078319 | A1 * | 4/2006 | Maran | 392/432 |
| 2007/0084105 | A1 * | 4/2007 | Lindsay et al. | 43/129 |
| 2009/0085713 | A1 * | 4/2009 | Tsang | 338/23 |
| 2013/0044997 | A1 * | 2/2013 | French | 392/360 |

* cited by examiner

INFRA-RED HEATER ASSEMBLY

CROSS REFERENCE TO RELATED APPLICATION

This non provisional patent application claims priority to the provisional patent application having Ser. No. 61/215,622, having filing date May 7, 2009.

BACKGROUND OF THE INVENTION

The infra-red heater assembly relates to heaters in general and more specifically to heaters that raise the ambient temperature in a room to over 140° F.

Hotels have people check in from all walks of life. Some hotel guests bring additional guests with them that stay beyond check out time. The additional guests include bed bugs among other insect. Cities with large numbers of hotel rooms report bed bug infestations: a significant problem in Las Vegas, New York City and Hawaii. The bed bugs arrive on a few hotel guests or their luggage and then the environment of the hotel allows the bed bugs to thrive. The bed bugs affect hotels of all star levels.

In recent years, hotels have fought the bed bugs in various ways. One prior art method of fighting bed bugs involves heated air. The heated air raises the room temperature high enough to kill off the bed bugs. The heated air is readily created by direct fire heaters, propane heaters or burners. Such heaters are presently used at construction sites and along the sidelines at wintry professional football games. The heaters generally burn propane and a fan drives air over the burner for heating. Propane tanks remain an explosion hazard. However, exterminators use heated air to eliminate the bed bugs but are not allowed to bring propane tanks into any building due to fire and building codes.

Additionally, hotel general managers and property owners seek to handle the bed bug infestation highly discretely and very quietly. The propane heaters move the heated air through a flexible duct system to reach the infested rooms. However, flexible ducts running up the stairs and down the corridors in five star hotels are just not permitted. Additionally, re-circulating air from a direct fired heated within an infested room or nearby hallway also is not allowed because the combustion products rise to unsafe levels rapidly.

Avoiding the fire and building code limits and direct fire heaters, today hotels attack bed bug infestations by stripping a room of its furnishings down to the structure, often bare concrete. This extreme method kills off a bedbug infestation but a hotel loses room night revenue and incurs the demolition and re-fitting costs. This method costs over $30,000 per room.

The present invention capitalizes on the advantages of electric infra-red heaters that operate upon 120 volt service that is readily available in an infested room and in adjacent hallways.

A unique aspect of the present infra-red heater assembly is a series of vertical panels with embedded heating elements that raise the ambient air temperature over 140° F. adjacent to a wall of a room.

DESCRIPTION OF THE PRIOR ART

Exterminating contractors presently fight bed bugs with various systems including direct fire heaters coupled with flexible ducts to deliver heated air to an infested room. The heaters are currently gas-fired salamanders in conjunction with flexible ducts that pump hot air into a room or other part of a building, or structure, subject to heating to exterminate the bedbugs.

Prior attempts at usage of infra-red heaters encountered difficulty in a field setting where a heater got to close to a wood floor joist. The heater then tended to char the wood. The resultant output of the test infra-red heater element depends upon the amount of energy transferred to a surface and how that surface then radiates the heat back to a room.

It is known from experimentation that various insects when exposed to 120° F. temperature has shown that there are no survivors from even a brief exposure to such temperatures. There may be some survivors at 115° F., but the longer this temperature is maintained, the fewer survivors exist. At 135° F., not only are there no survivors, but the insects appear to be dehydrated. Thus, 120° F. is a sufficiently elevated temperature for a short exposure to particular select insects. Obviously, a longer exposure may be needed for lower temperatures, and finally, a shorter exposure may be all that is required at higher temperatures.

The present invention can heat just a portion of a room, such as one infested wall, with a minimum of electricity.

When generating heat to kill off an infestation of unwanted insects or mold spores, an infra-red heating system can serve as the source of the heat. Infra-red heat is generally classified as low intensity (lower temperature and longer wave length) or high intensity (higher temperature and shorter wave length) based on the temperature output of the black body. High intensity is more reflective of the energy produced with light colored walls returning it to the room for absorption by darker colored objects. Low intensity tends to have more of its energy absorbed into a wall even with light colored paint coatings. The energy absorbed then is conducted to the wall cavity. In a bug-infested wall, the temperature inside the wall must rise to the killing temperature (approximately 130° F.) along with the surrounding room air, or a lower temperature may suffice if it is of a sustained usage and application. The low intensity infra-red heat serves that purpose well. The walls subjected to the infra-red heating also radiate heat back to the room and raise the room air temperature accordingly.

SUMMARY OF THE INVENTION

An infra-red heater assembly takes on pests and conditions that afflict present day buildings: bed bugs, termites, other insects, molds, bacteria, viruses, moisture, other organisms in structures, and their resulting odors, dusts, and other contaminants. The present invention includes a portable electric infra-red emitting panel system that has one or more infra-red panels vertically stacked, one on top of the other, as a continuous assembly or separate sections that provide distributed heat energy to the entire height of a wall beset by insects or other conditions. The assembly includes removable panel covers over the infra-red heating elements to protect them from damage during transport. The removable panel covers, when opened, act as deflectors, or shields, to channel, or direct, the radiant energy, widthwise, to limit or restrict the line of site energy transferred to a wall. The panel covers provide control to avoid overheating the wall, by an adjacent assembly as a result of overlapping the pattern of heat flux.

The construction of an infra-red panel of the present invention includes embedding nicrome wire into a potted substrate attached to a metal panel, and painted black to improve the emissivity of the heating surface and held within a frame. The back of a typical infra-red panel, or element, is heavily insulated to minimize any heat loss thereby, forcing more of the energy to escape to the room. In the present invention, the insulation has been minimized because it is desired to also heat the room by convection. Toward that end, perforations, or screens, have been added to the exterior bottom and top frame members of each of the infra-red panels to pull heat from the back of the infra-red elements and to utilize convection to disperse heat into the room to raise the room temperature more rapidly than with infra-red heating alone.

A temperature control and sensor included with this invention senses room temperature and interrupts the input power circuit when the desired room temperature is achieved. The invention also has a secondary controller integral to the heater assembly that utilizes an infra-red sensor and separate controller circuit to monitor the wall temperature to limit overheating, by interrupting the incoming power circuit with a second electrical contact. The infra-red wall sensor acts as a thermal limit similar to a high limit on other appliances, but it senses this temperature remotely from the appliance.

The present invention also includes other improvements: a folding foot design, that in the collapsed state, matches the same narrow thickness of the remainder of the invention and that permits the service technician to load a quantity of the heater assemblies on a cart small enough to fit through door openings, for easy movement of the invention from one area to another including the use of an elevator in multi-story hotels and condominiums. And the folding foot in the open state, or non-collapsed state, has the legs forming a structural footing that resists tipping in either direction. Though the present invention has feet for static positioning, the present invention can also be wheel mounted to assist in movement of the invention.

Numerous objects, features and advantages of the present invention will be readily apparent to those of ordinary skill in the art upon a reading of the following detailed description of the presently preferred, but nonetheless illustrative, embodiment of the present invention when taken in conjunction with the accompanying drawings. Before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, the phraseology and terminology employed herein are for the purpose of description and should not be regarded as limiting.

One object of the present invention is to provide a new and improved infra-red heater assembly.

Another object is to provide such an infra-red heater assembly having stacked infra-red panels that heat an entire wall from floor to ceiling.

Another object is to provide such an infra-red heater assembly having a shorter stature in order to apply heat, as, for example, in the area under a countertop or sink vanity to eliminate contaminants, or moisture, thereat.

Another object is to provide such an infra-red heater assembly that is readily installed by crews using existing exterminating techniques on the first time.

A further object is to provide such an infra-red heater assembly that requires minimal continual maintenance and attention from a contractor, hotel staff person, or property owner.

Another object is to provide such an infra-red heater assembly that has removable panel covers over the heating elements for protection during movement of the invention.

Another object is to provide such an infra-red heater assembly where the panel covers, when opened, restrict the field of vision for the radiant energy to transmit to the wall surface and avoid overheating the wall by other adjacent assemblies.

Another object is to provide such an infra-red heater assembly that has minimal insulation upon the rear surface of the heating element thus releasing heat from that surface into a room using convection through openings in the top and bottom frame members to raise the room temperature. This additional heating augments direct heating from the heating element itself upon the front surface of the assembly.

Another object is to provide such an infra-red heater assembly that has an integral temperature controller for monitoring and controlling the room temperature by interrupting electrical power.

Another object is to provide such an infra-red heater assembly that has an integral limit device to sense the remote wall temperature for prevention of damage to the wall finish and the wall structure.

Another object is to provide such an infra-red heater assembly that has a frame design with feet that provide a sturdy mounting when the assembly attains the open position and for ready movement of the assembly when in the collapsed position through minimal set-up and labor.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

Figure 6:
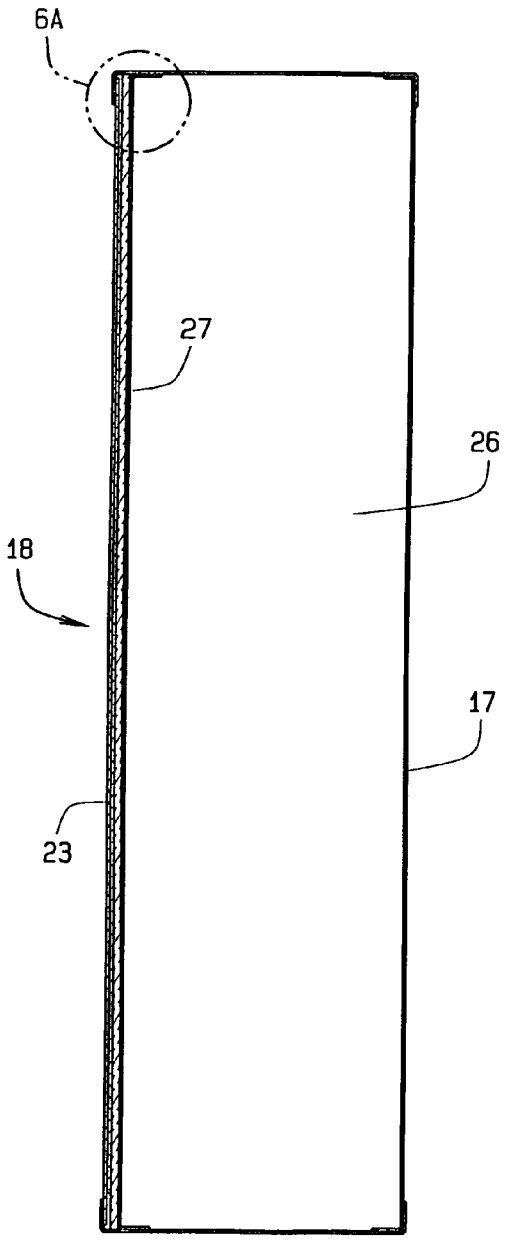
FIG. 6 describes a section view of the heating element.
Figure 7:
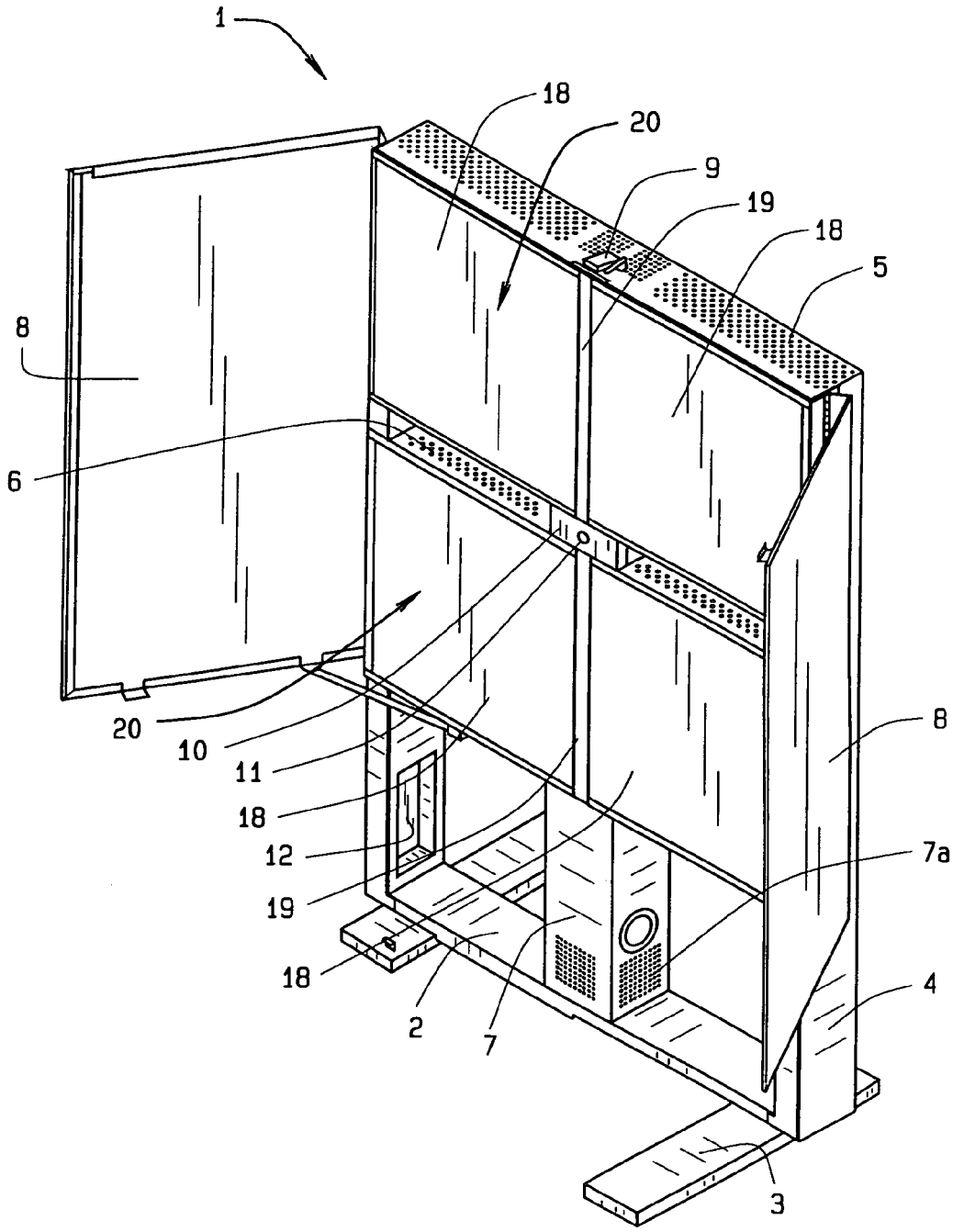
Figure 8:
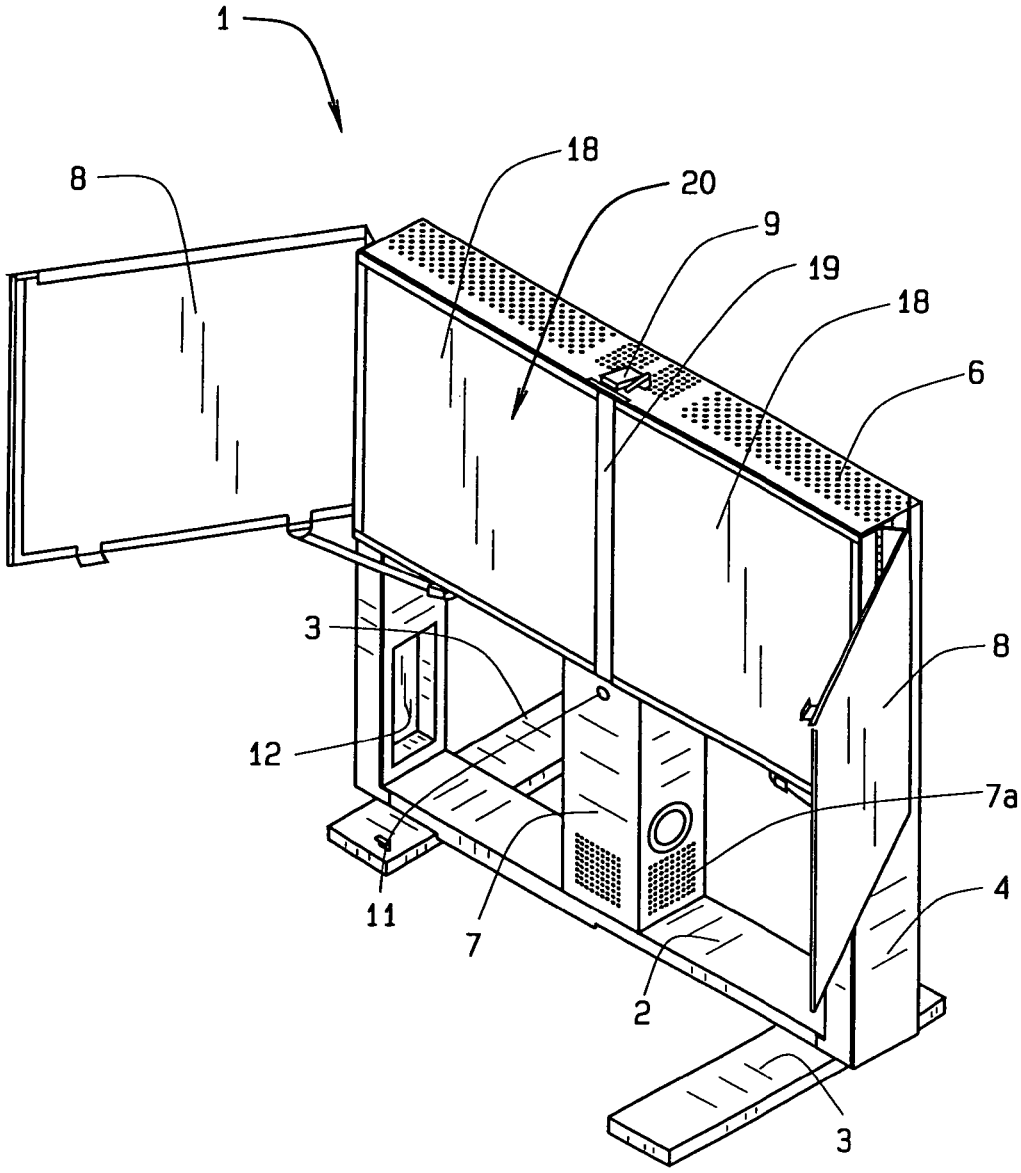
Figure 9:
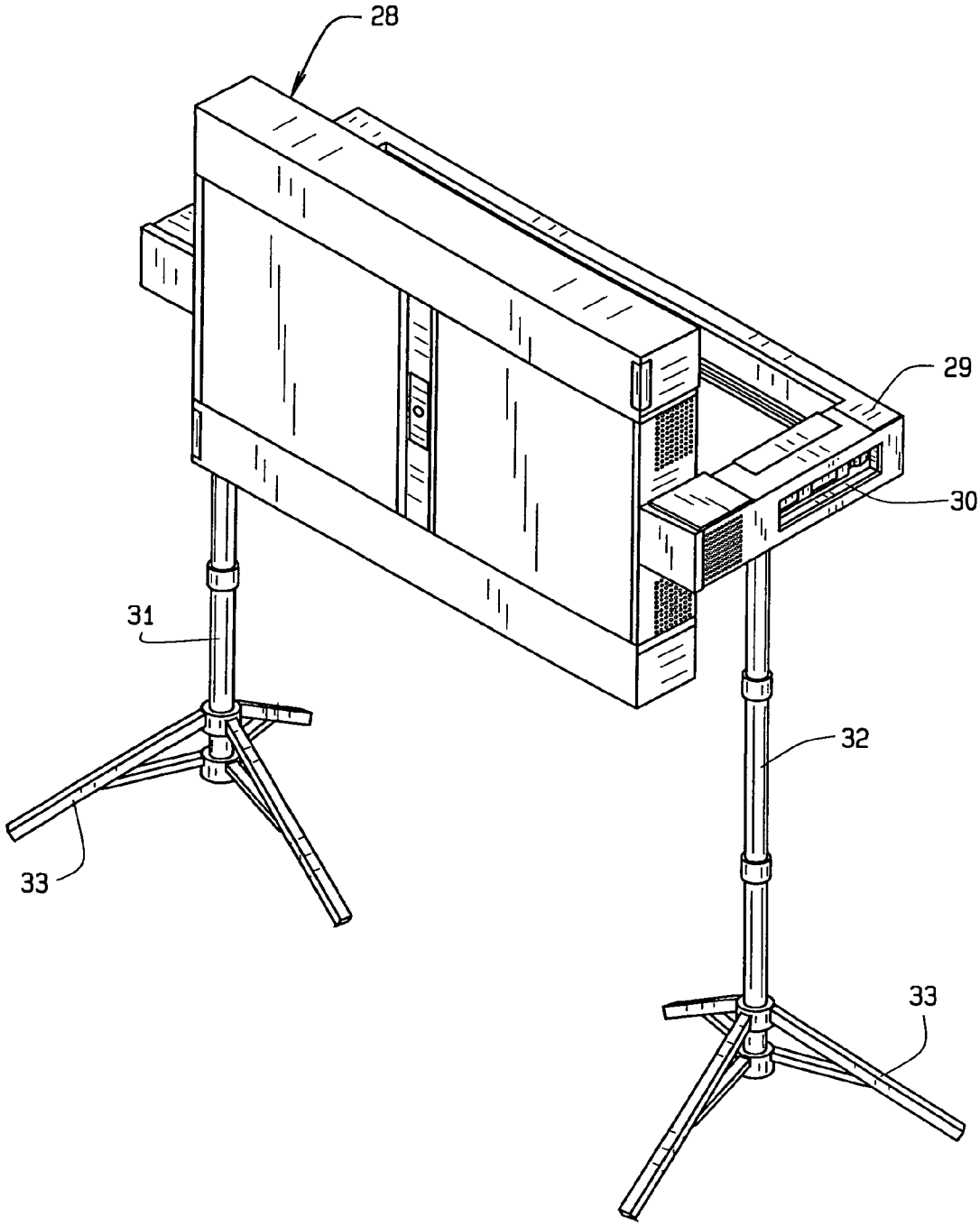
Figure 10:
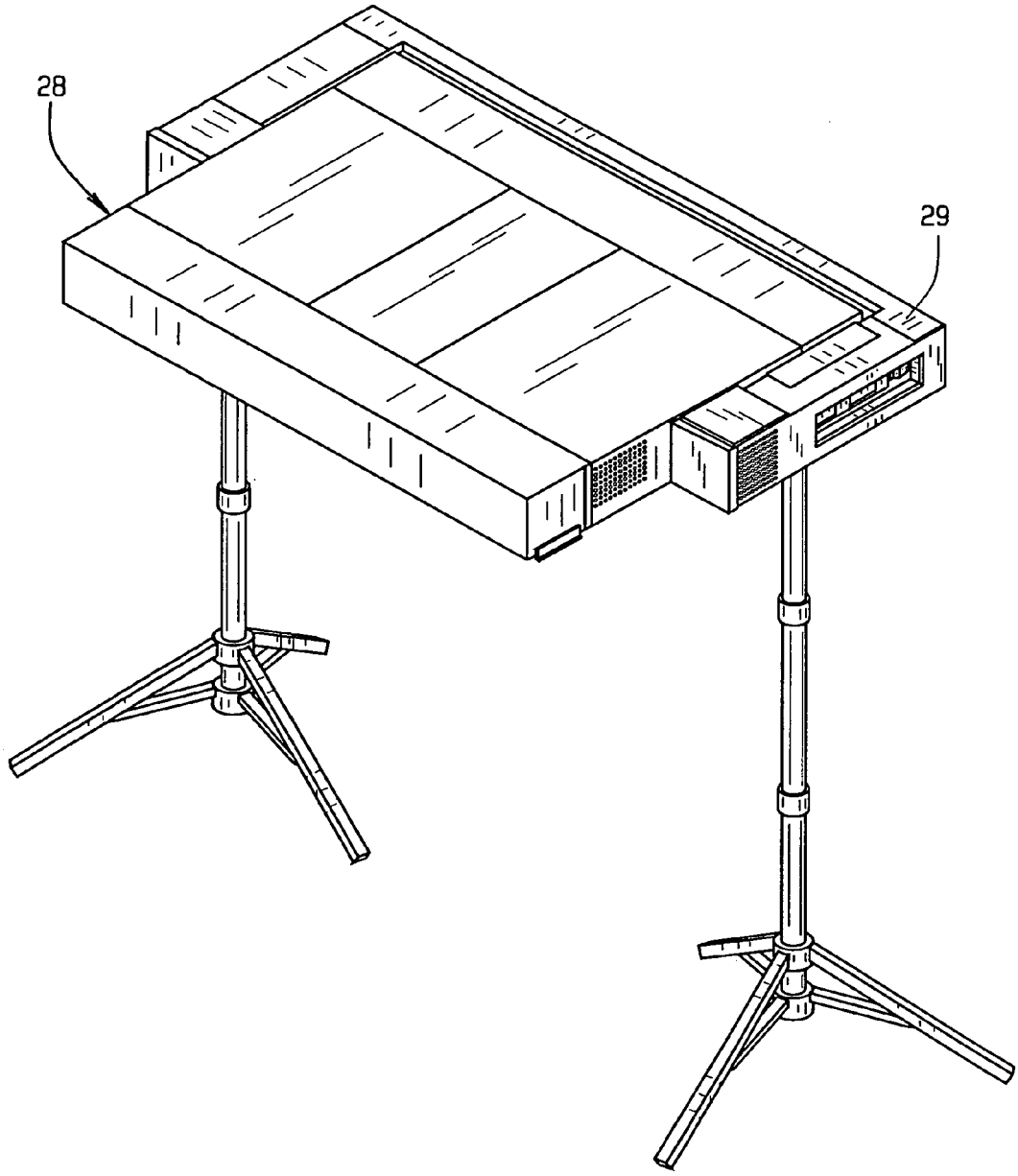

FIG. **6*a* is a section of the corner of the heating element of FIG. 6**;

FIG. 7 is a perspective view of the heating element with covers being opened;

FIG. 8 is a perspective view of a low profile heating element with its covers opened;

FIG. 9 shows a modification to the heating element, upon its stand, and how through its pivotal mounting can be adjusted to direct its infra-red heat in different directions of approximately 270° about its axis, but shown adjusted to emit heat horizontally of the shown structure; and FIG. 10 discloses the same infra-red heater of FIG. 9, but with its heating element arranged horizontally such that it can emit its infra-red heat either straight up, or down, through its adjusted usage.

The same reference numerals refer to the same parts throughout the various figures.

DESCRIPTION OF THE PREFERRED EMBODIMENT

Figure 1:
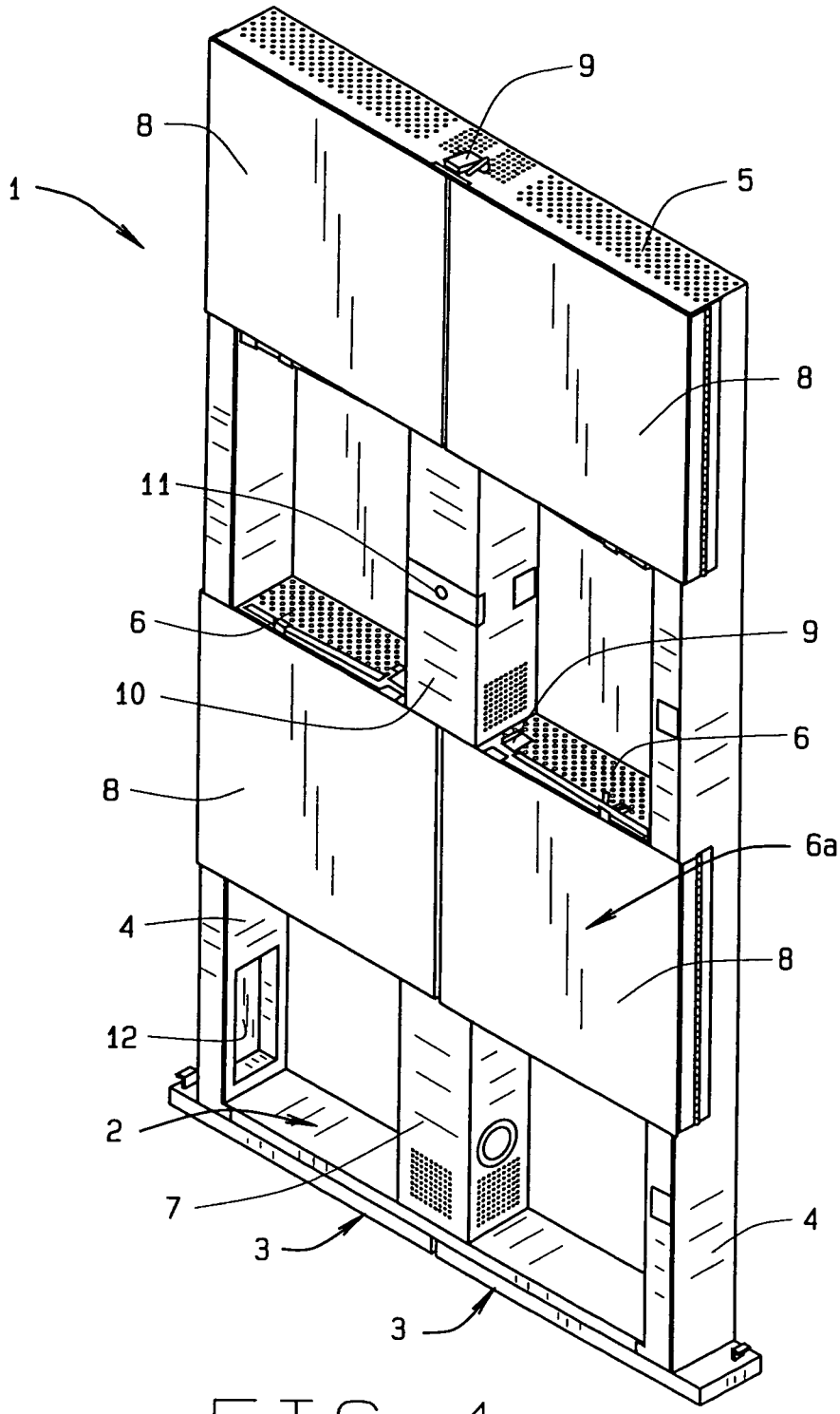
FIG. 1 shows a perspective view of the front of the preferred embodiment of the present invention of the infra-red heater assembly when in the closed position.

The present invention overcomes the prior art limitations by providing an infra-red heating assembly that raises room and wall temperatures to remove insect and mold infestation without damage to wall finishes and structures while using readily available electrical service. The present invention appears as a generally rectangular frame, which can fit through a personnel door, as shown in FIG. 1. The infra-red heater assembly 1 has a base 2, generally an elongated rectangular member of thin cross section compared to its length. Beneath the base, two feet 3 occupy the same footprint as the base and have a similar rectangular shape and similar cross section but approximately half the length of the base. The feet are generally parallel to the base when the assembly 1 is in the closed position for movement as shown in FIG. 1.

Upon the base opposite the feet 3, a pair of uprights 4 extends perpendicular to the base. The uprights are mutually parallel and spaced apart. Each upright connects to the base proximate each end of the base, generally outwardly of the separation in the feet near the center of the base. Each upright has a generally rectangular cross section. Opposite the base 2, the assembly has a screen, or first panel 5, that spans from upright to upright, including the ends of each upright. The panel is generally planar and has a plurality of openings in a pattern for ventilation. The panel is generally parallel to the base.

Locating approximately at the center of the height of each upright 4, the assembly 1 has a pair of spaced apart semi-panels, or second panels 6. Like the first panels 5, the semi-panels, 6 have a plurality of openings for ventilation. The semi-panels are parallel to the base and mutually coplanar and collinear. Between the base 2 and the lower panel 6, a box 7 is centered between the uprights. The box is generally elongated and parallel to the uprights, and it has the same depth as the uprights. The box contains the controls for the assembly 1 as will later be explained. Above the semi-panels 6 is the box 10 that contains the infra-red temperature sensor 11 positioned to collect the thermal footprint projected to the selected wall surface.

Beneath the semi-panels 6 and the box 10, each assembly has two covers 8, pivotally connected to the uprights. The axis of the pivoting is generally parallel to the outermost edge of the upright. Each cover spans from the outermost edge as shown towards the center of the assembly. Each cover has a generally rectangular, planar shape that temporarily secures to a latch 9. The latch can be of many varieties though a flanged latch is preferred for securing to a steel cover as in the preferred embodiment. The covers extend downwardly from the semi-panels 6 towards the base 2 for approximately half of the spacing between those two members. Above the box 10 and spaced apart from the semi-panels 6, the assembly has a second pair of covers 8. These covers also span from the outermost edges of the uprights inwardly and have a pivoting connection to the uprights 4. As before, these covers 8 are planar, generally rectangular in shape and secure to a flanged or other latch 9. This latch is generally centered upon the panel 5. In FIG. 1, the covers 8 are shown in the closed position where the covers engage the latches 9.

The far upright includes a pocket 12 for the storage of the operating instructions and the technical manual. This may have a cover.

Figure 2:
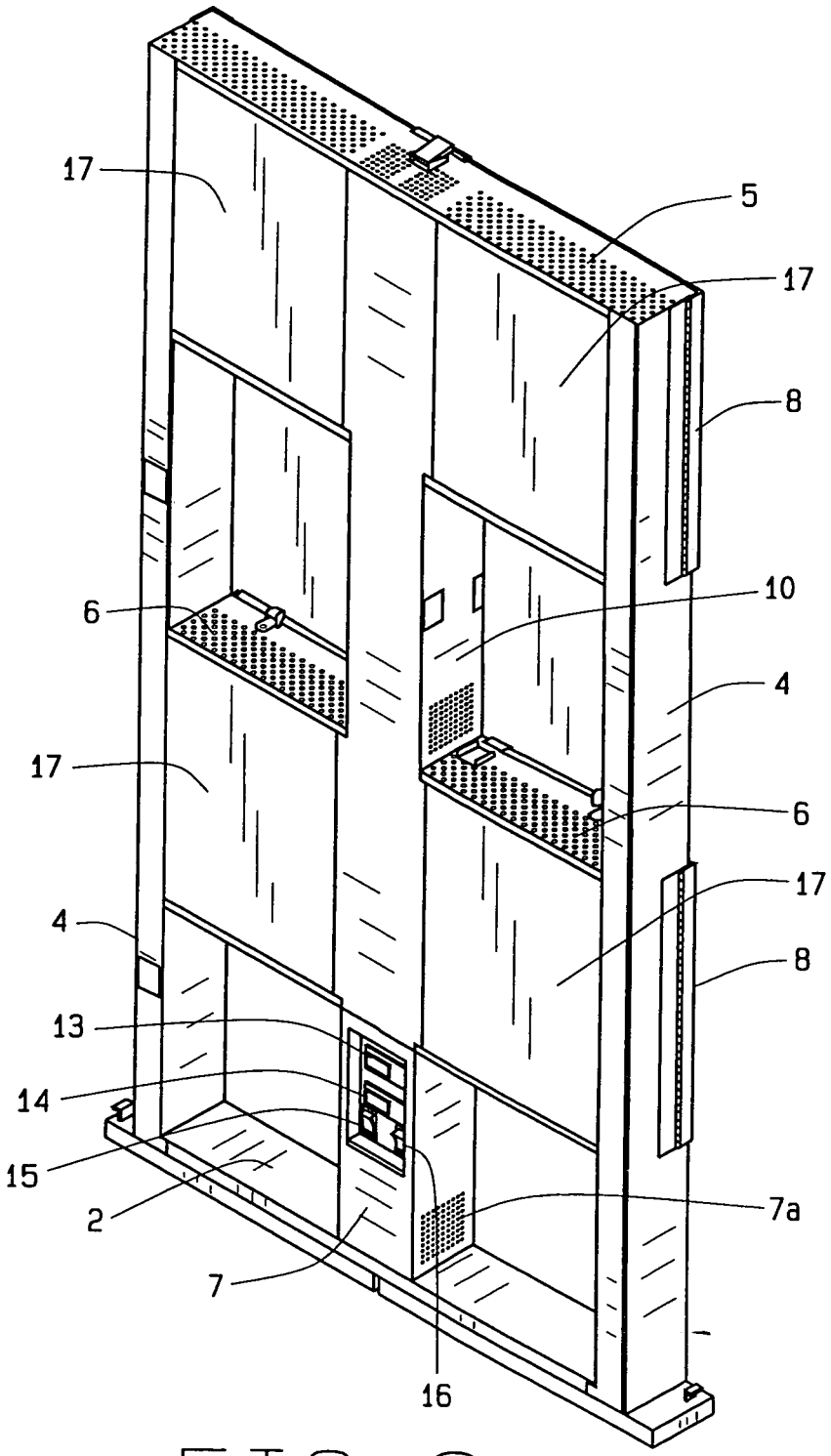
FIG. 2 shows a perspective view of the rear of the preferred embodiment.

Turning the invention 1, FIG. 2 shows the rear of the invention. The invention has the pair of mutually parallel and spaced apart uprights 4 upon a base 2 that is itself upon the pair of feet 3. Opposite the base, the assembly 1 has the panel 5 with openings for ventilation. Generally centered between the uprights, the assembly has a pair of semi-panels 6 that extend inwardly and parallel to the base. Centered in the assembly and parallel to the uprights below the pair of semi-panels 6, a box 7 spans between the semi-panels 6 and the covers 8 opposite the base.

The box 7 contains the mechanism for controlling the operations of the assembly 1. In the preferred embodiment, the box has a switch 15 that turns power on and off to the assembly, a switch 16 for selecting a 15-amp or 20-amp circuit, a room temperature controller 13 that detects the ambient air temperature proximate the assembly, and a wall temperature controller 14 that detects the surface temperature of a wall adjacent to the assembly. Both controllers 13, 14 are in the circuit of the switch 15 so that when either controller exceeds preset limits, the controller interrupts power to the assembly. The power interruption lasts until the temperature detected by the controller falls below the preset limits. Generally the wall temperature controller 14 has an upper limit of 175° F., and the room temperature controller 13 has an upper limit of 150° F. The box also has a plurality of openings, as at 7*a*, for ventilation of its internal electrical components.

Above the box 7, the assembly has a back 17 that spans from upright to upright 4. The back is generally rectangular and planar and occupies the footprint behind the covers 8. Above the box 10, another back 17 is provided from upright to upright and generally behind the second pair of covers 8. The covers 8 are generally flush with the outermost edge of the uprights, the panel 5, and the semi-panels 6.

Figure 3:
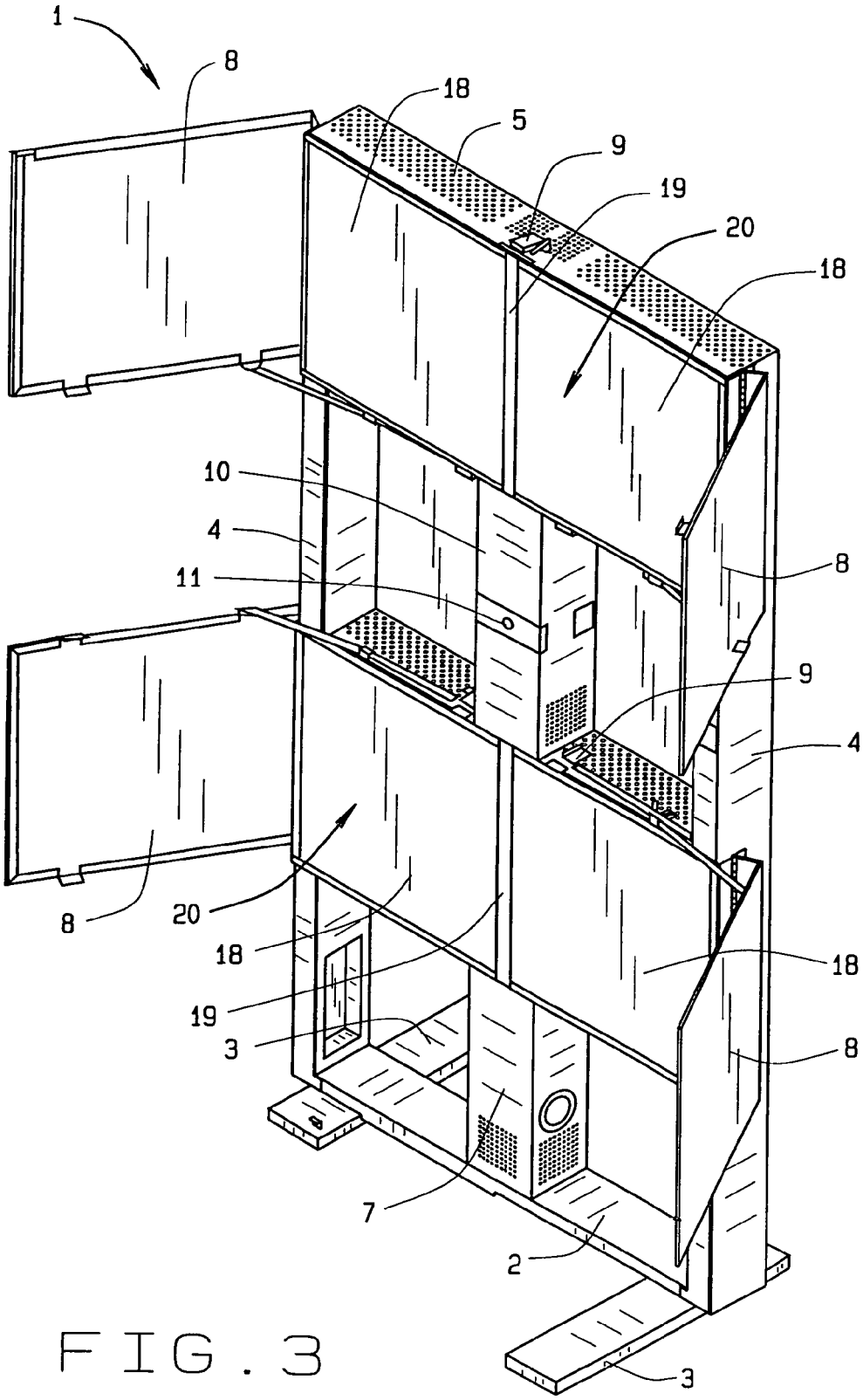
FIG. 3 describes another perspective view of the front of the preferred embodiment but with the assembly in the open position.

Once the assembly 1 is moved into a location and connected to electrical power, the assembly is placed in the open position shown in FIG. 3, though similar in appearance to FIG. 1, the covers 8 are opened, in FIG. 3, by pivoting upon the uprights 4 and outwardly from the box 10. Additionally, the feet 3 are rotated outwardly from the base, one foot clockwise and the other foot counterclockwise. The feet open to mutually parallel positions but offset from one another. The feet are also generally perpendicular to the base and prevent the assembly from tipping either forward or rearward.

Above the box 7, the covers 8 open to reveal two heaters 18. Each heater is generally rectangular and spans between an upright 4 and a center member 19. The center member is parallel to the upright and generally centered upon the assembly. Each heater overlaps the edge of the upright but does not engage the pivoting or hinging of the covers. Above the box 10, a pair of covers 8 also open to reveal two additional heaters 18. These heaters, like their lower counterparts, span from the uprights inwardly to a center member 19. These heaters extend from the edge but do not interfere with the hinges of the covers. The heaters are generally rectangular and planar. The heaters 18, generally four in number for the preferred embodiment, are in electrical communication with the box 7 and its switches 15 and 16 and controllers 13 and 14. Generally infra-red radiation and heat disperse from the heaters at the surface, the front surface 20, as exposed when the covers are open as shown in FIG. 3. When each cover is open, it can be adjusted to restrict the field of vision for the radiant energy to transmit to the wall surface and avoid overheating the wall by other adjacent assemblies.

Figure 4:
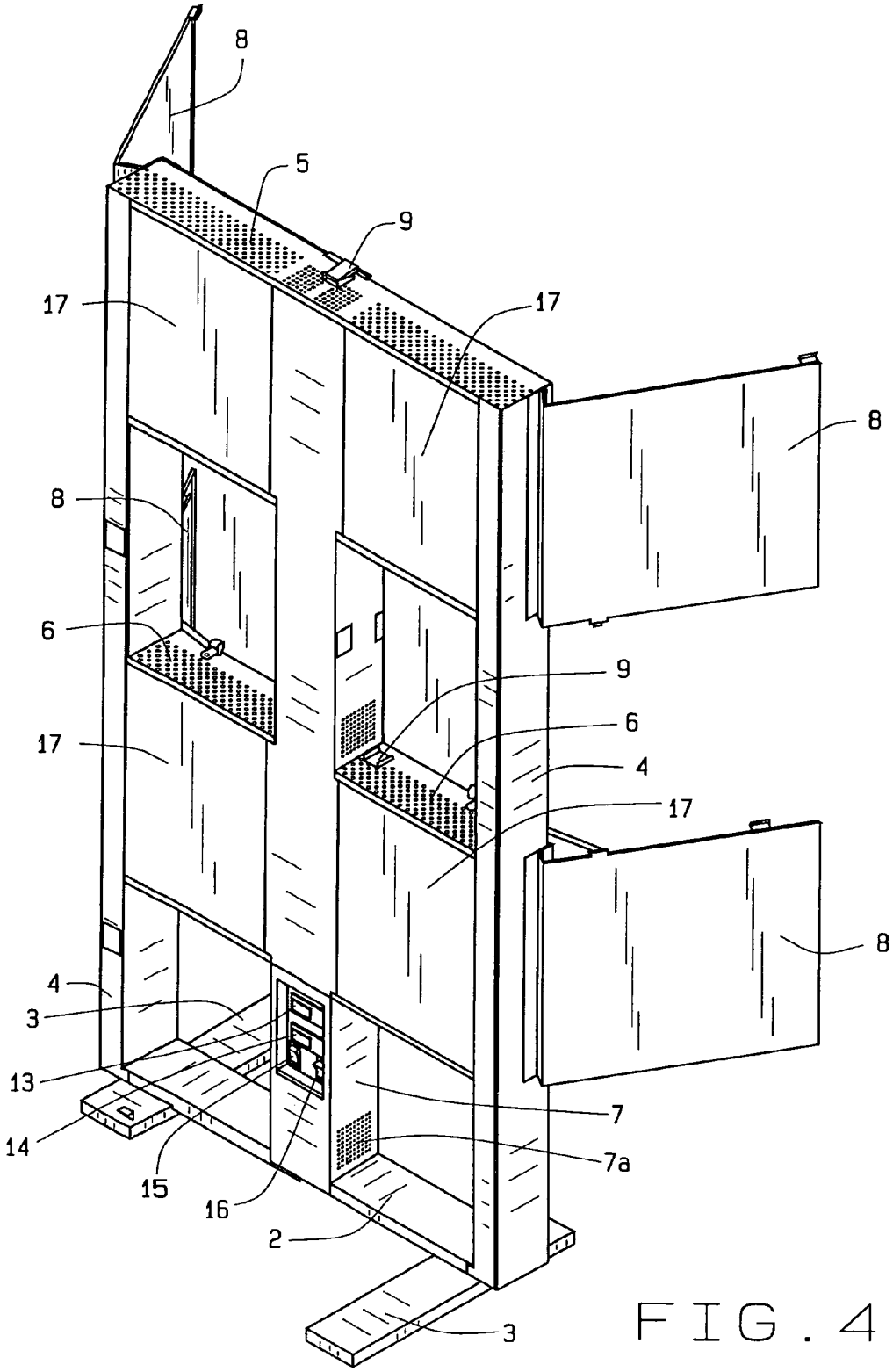
FIG. 4 also describes another perspective view of the rear of the preferred embodiment in the open position.

Turning the heater assembly when open, FIG. 4 shows the rear of the assembly. As in FIG. 3, the assembly has a base 2 with two feet 3 rotated outwardly in opposite directions. The feet are parallel but offset with one foot upon each face of the assembly, one to the front and one to the rear. Above the base, two mutually parallel and spaced apart uprights 4 extend perpendicular to the base. The uprights generally have the same width as the base. Upon each upright, two covers 8 are shown opened outwardly and away from the upright. The covers have a hinged connection to their respective upright.

Inside of the uprights, the assembly has a pair of semi-panels, as at 6, generally centered upon the height of the assembly and that extend parallel to the base 2. The semi-panels extend short of the center of the assembly where a box 10 follows the centerline of the assembly also upwardly and away from the base. As described before, the box 7 has the switch 15 for providing power to the assembly, a switch 16 for selecting a 15- or 20-amp circuit, a room temperature controller 13, and a wall, or surface, temperature controller 14, here shown above the controller 13. The switch and controllers are generally located just above the base. Flanking the box 10, each screen has a latch 9 generally towards the front of the invention that secures the cover 8 when the invention is closed, as previously shown in FIG. 1. Beneath the box 10, a back 17 spans across from upright to upright 4 and from the semi-panels 6 downwardly to the top edge of the box 7, approximately the height between the base and the semi-panels 6.

Above the box 10 and spanning upright to upright opposite the base, the assembly has a larger panel 5. Centered upon the panel 5, another latch 9 secures the upper covers 8 when the invention is in the closed position. Between the panel 5 and the box 10 and from upright to upright, a back 17 closes the rear of the invention and generally the upper heaters. The backs 17 generally have minimal insulation and an air gap that is ventilated upward to utilize convection heat to help warm the room. The invention generally emits its radiation forward.

Figure 5:
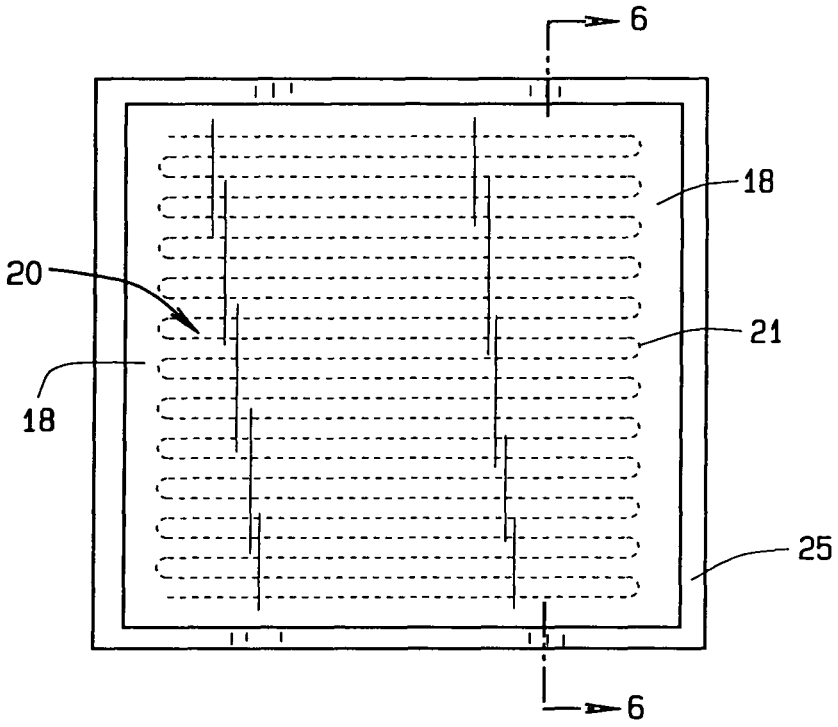
FIG. 5 illustrates a front view of the heating element of the present invention.

Within the framework of the present invention, the heaters 18 generate low intensity infra-red radiation and heat from generally planar panels as shown in FIG. 5. In the preferred embodiment, a heater is generally rectangular in shape and with a black coating upon the front surface 20, for greater emissivity. Embedded in the heater, a heating element, as at 21, produces infra-red radiation and heat from electricity supplied through the switch 15. In the preferred embodiment, the heating element is ni-chrome wire placed in a pattern upon the entire surface 20 so that the heater evenly radiates heat outwardly of the invention.

Figure 6A:
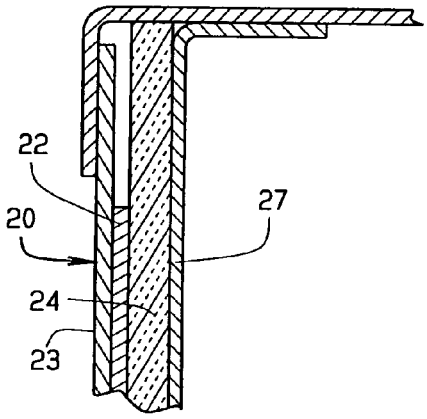

FIG. 6 shows the construction of a heater in a sectional view where the heater evenly radiates heat towards the front of the invention. The heat emanates from ni-chrome wire 21 embedded in a potted substrate 22. The substrate is generally rigid and readily transmits infrared radiation therethrough. The substrate withstands the heat generated proximate the ni-chrome wiring and the handling of the invention. Upon the front surface 20 of the heater, the metal front plate has a coating of black paint 23 in at least one layer. The paint 23 guides the infra-red radiation to emit from the front surface and reflects any incident infra-red radiation that encounters the heater 18 outwardly. Upon the opposite surface of the substrate, at least one layer of insulation 24 is applied upon the entire surface of the substrate. See also FIG. 6*a*. The insulation reduces the leakage of infrared radiation from the rear of the heater and directs the majority of the heat from the rear surface of the substrate to return to the front surface 20 and then outward from the invention. The various layers of the heater are adhered together in a stacked form and are secured upon the perimeter of each heater in a frame with appropriately dimensioned channels 25. Between the insulation 24, the backer plate 27, and the rear panel 17 an air gap that is ventilated carries the residual heat to the room as convection heat.

FIG. 7 shows a slight modification of the invention where the height of the box 10 is drastically reduced to improve the handling of the heater. The infra-red sensor 11 is located in the box 10 and all other features are retained in the preferred embodiment, except the covers 8 are combined on each side. The covers 8 can be adjusted to restrict the field of vision for the radiant energy to transmit to the wall surface and avoid overheating the wall by other adjacent assemblies.

FIG. 8 shows another version of the invention that consists of two panels instead of four, and the heating capacity is half of the taller models. The infra-red sensor 11 is relocated to box 7, and all other of the preferred embodiment are retained.

FIGS. 9 and 10 disclose a further modification to the structure of the heater assembly. In this instance, each heater 28 is structured for pivotal mounting within its framework 29. The framework includes the various controls, as at 30, for regulation of the heater, similar to the controls as previously described. The framework mounts upon a pair of legs, as at 31 and 32, which may be telescopically structured for providing greater elevation, as for heating a ceiling, or lowered, as for heating the floor beneath. But, as can be seen in FIG. 9, the heater 28 is pivotal about its framework, generally can be adjusted approximately 270 degrees, more or less, for providing an orientation to the direction of which the infra-red heat is emitted, during usage of the device. As can be seen in FIG. 9, the heater is arranged vertically, as when heating a proximate wall. But, as can be seen in FIG. 10, the heater 28 is directed upwardly, as for heating a location on the ceiling, or the heater can be pivoted 180 degrees, and directed downwardly, for emitting heat downwardly towards a lower region, such as the floor therebelow. Each of the legs 31 and 32 include a stand 33, for allowing for quick assembly, when readied for usage. Or, the stand may be slid upwardly, as when the unit is disassembled, after usage, in the manner as can be understood.

From the aforementioned description, an infra-red heater assembly has been described. The infra-red heater assembly is uniquely capable of directing infra-red radiation and heat towards the front of the assembly and heating air and an adjacent surface to at least 140° F. The assembly has sensors that shut off the electricity to the heaters when surface and air temperatures exceed certain limits. The infra-red heater assembly contemplates using materials and various components that may be manufactured from many materials including but not limited to polymers, high density polyethylene HDPE, polypropylene PP, silicon, polyvinyl chloride PVC, nylon, ferrous and non-ferrous metals, their alloys and composites.

The phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Therefore, the claims include such equivalent constructions insofar as they do not depart from the spirit and the scope of the present invention.

We claim:

1. An assembly for heating a wall and a room, comprising:

a frame, said frame having a base, two spaced apart uprights upon said base, and at least a foot below said base to stabilize the assembly when erected;

a pair of panels spaced apart from said base and spanning between said uprights, a control box, generally arranged between said uprights in the assembly and upon said base and arranged proximate said panels, said control box including a switch to interrupt electrical service to said assembly, a room temperature sensor to detect ambient air temperature in the vicinity of said assembly, and a controller to interrupt electrical service to said assembly when a high air temperature is attained;

an infra-red wall temperature sensor to detect the temperature of a nearby surface proximate said assembly, and a separate controller to interrupt electrical service to said assembly when a high surface temperature is detected;

a low intensity infra-red heater operatively associated with each panel, a first heater located with the first panel, and the second heater located with the second panel, said heaters denoting the front of said assembly, each of said heaters having a pivoting cover connected upon one of said uprights, and each of said covers having a closed position generally upon the entire surface of said heater, and an open position exposing the entire surface of said heater, and each heater having a back generally located behind and opposite said exposed infra-red heaters;

each of said heaters having a heating mechanism that generates low intensity infrared radiation, and said control box being located proximate said heaters, and said room temperature sensor interrupting electrical service to said assembly when a temperature over 120° F. is detected, and said wall temperature sensor interrupting electrical service to said assembly when a temperature over 150° F. is detected; and said heaters operating electrically upon less than 250 volts.

2. The room and wall heating assembly of claim 1, and further comprising:

each of said heaters having a heating mechanism that generates low intensity infra-red radiation.

3. The room and wall heating assembly of claim 1, and further comprising:

each of said heaters having a potted substrate, generally in planar form with a front surface and an opposite rear surface, said front surface emitting low intensity infra-red radiation when said covers are in the open position, at least one electrical heating element embedded within said substrate and in electrical communication with said switch and said room temperature sensor and said wall temperature sensor, and at least one layer of insulation applied to said rear surface.

4. The room and wall heating assembly of claim 1, and further comprising:

four of said heaters, two of said heaters locating beneath said first panel and two of said heaters locating beneath said second panel.

5. The room and wall heating assembly of claim 1, wherein said front surface is generally black.

6. The room and wall heating assembly of claim 1, and further comprising:

a frame upon the perimeter of each of said heaters, having members with a generally U shaped in cross section containing said potted substrate and said insulation.

7. The room and wall heating assembly of claim 1, further comprising:

each of said covers having a switch interrupting electrical service to one of said heaters when said cover is in the closed position.

8. The room and wall heating assembly of claim 1, wherein said covers when opened space said assembly from adjacent structures and other of said assemblies.

9. The room and wall heating assembly of claim 1, and further comprising:

two of said feet having a generally elongated rectangular planar shape, pivotally connected beneath said uprights, said feet storing beneath said base and said feet pivoting from said base generally perpendicular to said uprights and to said base.

10. An assembly for heating the surfaces and air within a room to a temperature for removal of insect and fungal infestations, comprising:

at least one low intensity infra-red heater, said heater generating radiant and convective heat;

at least one sensor detecting ambient air temperature in the vicinity of said assembly and the temperature of a nearby surface of the room, said sensor then interrupting operations of said heater upon detecting a certain temperature;

each of said heaters having a pivoting cover, said cover having a closed position generally upon the entire surface of said heater and an open position exposing the entire surface of said heater;

each of said heaters having a potted substrate with a front surface and an opposite rear surface, said front surface emitting low intensity infra-red radiation when said covers are in the open position, and at least one electrical heating element embedded within said substrate and in electrical communication with said sensor, and at least one layer of insulation applied to said rear surface; and said heater operating electrically upon less than 250 volts.

11. The assembly for heating the surfaces of air within a room as set forth in claim 10, wherein said heater is mounted within a supporting structure, and said heater is pivotal within said supporting structure so as to direct its generated infra-red heat in various angular directions within the room being treated.

12. The heater assembly to remove infestations of claim 10 further comprising:

said sensor interrupting said heater upon detecting an air temperature over 140° F., or upon detecting a surface temperature over 200° F.

13. An assembly for heating the surfaces and air within a room to a temperature for removal of insect and fungal infestations, comprising:

at least one low intensity infrared heater, said heater generating radiant and convective heat;

at least one sensor detecting ambient air temperature in the vicinity of said assembly and the temperature of a nearby surface of the room, said sensor then interrupting operations of said heater upon detecting a certain temperature; and a collapsible frame containing said heater and said sensor therein.

* * * * *